United States Patent [19]

Panigoni

[11] 4,109,558

[45] Aug. 29, 1978

[54] SEMI-AUTOMATIC GUN

[75] Inventor: Giannantonio Panigoni, Brescia, Italy

[73] Assignee: Luigi Franchi S.p.A., Brescia, Italy

[21] Appl. No.: 732,059

[22] Filed: Oct. 13, 1976

[30] Foreign Application Priority Data

Nov. 21, 1975 [IT] Italy ..... 29528 A/75

[51] Int. Cl.[2] ..... F41D 5/04

[52] U.S. Cl. ..... 89/191 A

[58] Field of Search ..... 89/191 A

[56] References Cited

U.S. PATENT DOCUMENTS 3,810,412 5/1974 Zamacola ..... 89/191 A

*Primary Examiner*—Stephen C. Bentley

*Attorney, Agent, or Firm*—Birch, Stewart, Kolasch and Birch

[57] ABSTRACT

A semi-automatic gun having a gas operated device for actuating a reloading mechanism thereof. The reloading mechanism includes a cartridge magazine which extends parallel to the gun and the actuating device includes an annular piston sliding over the cartridge magazine in an annular chamber defined between the cartridge magazine and a cylinder, closed at one end, which surrounds a portion of the cartridge magazine. Gas transfer ducts convey gas from the interior of the barrel of the gun, through the wall of the cylinder into the annular chamber defined thereby. The annular piston has a peripheral groove therein at a position adjacent the gas transfer ducts so that gas entering the annular chamber impinges on the piston and not on the wall of the cartridge magazine; subsequently these gases transfer to a lower chamber between the end of the piston and the closed end of the annular chamber along a passage between the piston and the wall of the chamber itself.

4 Claims, 3 Drawing Figures

SEMI-AUTOMATIC GUN

BACKGROUND OF THE INVENTION

1. Field of the Invention

The present invention relates to a semi-automatic gun, in which part of the gas evolved upon detonation of a cartridge in the breech of the gun is used to actuate a reloading mechanism. In particular the invention relates to a rifle having a reloading mechanism of the type which includes a cylinder fixed to the barrel of the rifle and encircling a portion of a cartridge magazine which extends parallel to the barrel, the cylinder and the encircled portion of the magazine forming an annular chamber which is closed at one end and open at the other end, at least one gas duct leading from the barrel to the said annular chamber, and a tubular piston slidable along the annular chamber between the magazine and the said cylinder and defining a power chamber between itself and the closed end of the annular chamber.

2. Prior Art

Known actuating devices of this type for reloading mechanisms suffer from a number of disadvantages. For example, high temperature gases entering the annular chamber impinge on the wall of the magazine and can cause damage which may be sufficiently severe as to result in the piercing of the magazine wall. Moreover, the kinetic energy of the gases evolved upon detonation of different types of cartridge varies widely and the actuating device for the reloading mechanism must be such that it will satisfactorily operate with low power cartridges while nevertheless not be damaged by high power cartridges.

SUMMARY OF THE INVENTION

According to the present invention a semi-automatic gun including a gas operated device for the actuation of a reloading mechanism of the gun, wherein the actuation device comprises a cylinder fixed to the barrel of the gun and surrounding a portion of a cartridge magazine which extends parallel to the barrel, the cylinder and the said portion of the magazine forming an annular chamber closed at one end and open at the other end, at least one gas transfer duct passing through the barrel and the cylinder, a tubular piston surrounding the said magazine and projecting at one end into the said annular chamber so as to be slidable along the said annular chamber. A power chamber being defined between the end face of the piston at the said one end thereof and the closed end of the annular chamber, is characterised in that the said piston has, adjacent the said one end thereof, at least one annular groove in gas communication with the said power chamber through at least one gas transfer passage, the said gas transfer duct passing through the barrel of the gun and the said cylinder being positioned such that gases flowing therethrough from the interior of the barrel when the gun is fired impinge upon the said groove.

Embodiments of the invention have the advantage that they introduce a delay in the opening of the cartridge chamber of the breech block in addition to the usual mechanical delay, thus preventing the build up of dangerous pressures in the cartridge chamber. Another advantage of embodiments of the present invention is that it requires only a limited number of parts, and this simplifies the assembly, tuning and maintenance operations.

In a preferred embodiment of this invention the said gas transfer passage is an annular space of predetermined size between the inner wall of the cylinder and the end portion of the piston between the said annular groove and the said end face of the piston.

Likewise it is preferred that the said annular groove is coaxial to the piston and is defined by walls of unequal height.

BRIEF DESCRIPTION OF THE DRAWINGS

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from the detailed description.

Two embodiments of the invention will now be more particularly described, by way of example, with reference to the accompanying drawings, which are given by way of illustration only and thus are not limitative of the present invention, and wherein.

DETAILED DESCRIPTION OF THE INVENTION

Figure 1:
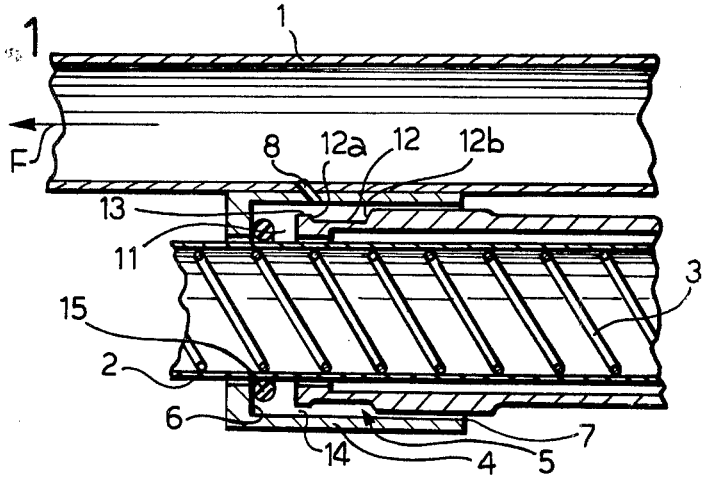
FIG. 1 is an axial section of a first embodiment of the invention.

Referring now to the drawings, there is shown a barrel 1 of a semi-automatic game gun having a cartridge magazine 2 which extends parallel to and beneath the barrel 1. Within the cartridge magazine 2 is a spring 3 which urges one or more cartridges (not shown) along this towards a cartridge reloading mechanism (also not shown). The arrow F shows the direction of travel of the firing gases in the barrel 1.

Surrounding a part of the magazine 2 and coaxial therewith is a cylinder 4, fixed in a known way to the barrel 1. The cylinder 4 defines, with the magazine 2, an annular chamber 5 which is closed at the muzzle end 6 and open at the other end 7.

A gas transfer duct 8 provides communication between the barrel 1 and the annular chamber 5. A tubular piston 9, which is mounted in sliding fashion on the magazine 2, projects into the annular chamber 5. The piston 9 is connected, in a known way, e.g., linkages (not shown), for the operation of the reloading mechanism (not shown) of the gun upon displacement of the piston 9.

The space in the annular chamber 5 between the muzzle end **9*a* of the piston 9 and the closed end 6 of the chamber 5 constitutes a power chamber 11. Adjacent the muzzle end 9*a* of the piston 9 there is an annular groove 12 having a predetermined width and depth, which groove is defined by walls 12*a*, 12*b* of unequal height. The groove 12 is located in a part of the piston 9 which is adjacent the gas transfer duct 8 through which gas from the barrel 1 is transferred into the chamber 5. The portion 13 of the piston 9, between the groove 12 and the muzzle end 9*a* of the piston 9 defines, with the internal wall of the cylinder 4, an annular gas transfer passage 14 of predetermined area, which passage permits communication between the groove 12 and the power chamber 11**.

The closed end of the cylinder 4 is sealed to the cartridge magazine by a sealing gasket, for example an O-ring, to prevent gas escaping from the power chamber 11 through the junction between the closed end of cylinder 4 and the cartridge magazine 2 in operation of the device.

When a cartridge is fired in the gun, a proportion of the gases evolved in the barrel 1 are transferred by the duct 8 into the chamber 5. These gases flow first into the annular groove 12 of piston 9, where they undergo a first expansion, and then they pass through the annular passage 14 into the power chamber 11 where they act on the end of the piston 9 urging it towards the breech of the gun.

Because the high temperature gases entering the cylinder 4 through the duct 8 strike the bottom of the groove 12 of the piston 9, rather than the wall of the magazine 2, as is customary in similar devices known in the art, the magazine 2 is protected from the damage which such gases would cause due to their high pressure, their high temperature, their speed and their corrosiveness. Moreover, the throttling effect on the gases by the narrow annular passage 14 between the groove 12 and the power chamber 11, has the effect of delaying the action of the gases on the piston 9, this delay being additional to the usual mechanical delays in the opening of the cartridge chamber and serving as an additional safety factor preventing premature opening of the cartridge chamber.

Figure 2:
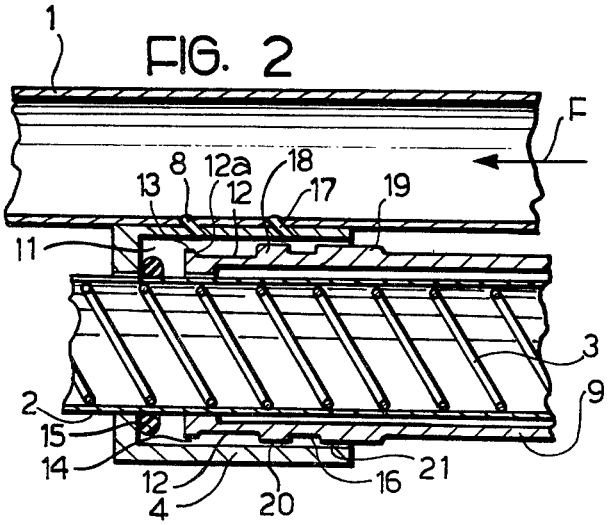
FIG. 2 is an axial section of a second embodiment of the invention.
Figure 3:
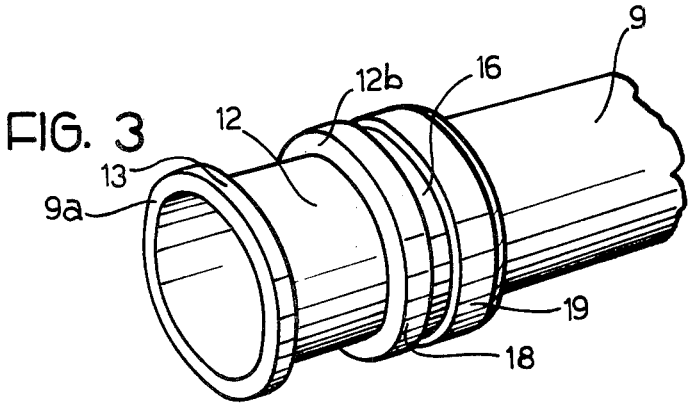
FIG. 3 is a perspective view of a tubular piston forming part of the embodiment of FIG. 2.

In the alternative embodiment shown in FIGS. 2 and 3 the same reference numbers are used to indicate the same or corresponding parts of the device as described with reference to FIG. 1. In fact, the device is largely the same as the embodiment of FIG. 1, except that the piston 9 has a second annular groove 16 between the annular groove 12 and the open end of the chamber 5. The second groove 16 has an essentially rectangular section of predetermined width and depth. The second groove 16 forms, with the internal wall of cylinder 4, an annular chamber which communicates with the barrel 1 of the gun through a second gas transfer duct 17 of substantially the same size and inclination as the first gas transfer duct 8. The annular portion 18 of piston between the second groove 16 and the first groove 12, and the annular portion 19 of the piston extending from the second groove 16 to the open end of the cylinder 4 form, with the wall of the cylinder 4, substantially identical narrow annular passages 20, 21 which are smaller than the gas transfer passages 14 between the groove 12 and the power chamber 11. The function of the annular groove 16 which is fed, when a cartridge is fired, with firing gases transferred through the duct 17, is to provide a so-called "gaseous diaphragm" of gas under pressure which resists the flow of gas from the first annular groove 12 towards the open end of the annular chamber 5. This construction is more fully described in our Patent Application No. 715,580, filed Aug. 18, 1976 (corresponding to Italian Patent Application No. 27752 - A/75 filed on the 29.9.1975 and which is cited here for reference purposes.

The present invention has a further advantage due to the fact that, during the transfer of gas through the passage 14, the piston moves in the opposite direction so that there is a pneumatic scraping of any deposits which might otherwise have been deposited on the end portion 13 of the piston 9.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A semi-automatic gun having a cartridge magazine which extends parallel to the barrel of the gun and a gas operated device for the actuation of a reloading mechanism of the gun, said actuation device comprising:

a cylinder fixed to the barrel of said gun and surrounding a portion of said cartridge magazine, said cylinder and said portion of said cartridge magazine defining an annular chamber closed at one end and open at the other end;

means defining at least one gas transfer duct passing through said barrel and said cylinder;

a tubular piston surrounding said magazine and projecting at one end into said annular chamber, said piston being slidable along said annular chamber, a end face of said piston at said one end thereof and said closed end of said annular chamber defining between them a power chamber;

said tubular piston includes an outer surface and means defining at least one annular groove in said outer surface adjacent said one end of said piston, said annular groove being coaxial to said piston and having side walls of unequal height; and a gas transfer passage communicating between said power chamber and said annular groove in said piston, said gas transfer duct which passes through said barrel of said gun and said cylinder being positioned such that gases flowing therethrough from the interior of said barrel when said gun is fired impinge upon said groove in said tubular piston.

2. A gun as in claim 1, wherein said gas transfer passage is an annular space of predetermined size between the inner wall of said cylinder and the end portion of said piston between said annular groove and said end face of said piston.

3. A semi-automatic gun having a cartridge magazine which extends parallel to the barrel of the gun and a gas operated device for the actuation of a reloading mechanism of the gun, said actuation device comprising:

a cylinder fixed to the barrel of said gun and surrounding a portion of said cartridge magazine, said cylinder and said portion of said cartridge magazine defining an annular chamber closed at one end and open at the other end;

means defining at least one gas transfer duct passing through said barrel and said cylinder;

a tubular piston surrounding said magazine and projecting at one end into said annular chamber, said piston being slidable along said annular chamber, a end face of said piston at said one end thereof and said closed end of said annular chamber defining between them a power chamber;

said tubular piston includes an outer surface and means defining at least one annular groove in said outer surface adjacent said one end of said piston;

a gas transfer passage communicating between said power chamber and said annular groove in said piston, said gas transfer duct which passes through said barrel of said gun and said cylinder being positioned such that gases flowing therethrough from the interior of said barrel when said gun is fired impinge upon said groove in said tubular piston;

said tubular piston includes a second annular groove spaced from said at least one annular groove and on the side thereof remote from said one end of said piston, said second annular groove forming, with the inner wall of said cylinder, an annular chamber; and at least one second gas transfer duct passing through said barrel and said wall of said cylinder, communicating with the interior of said barrel of said gun and with said annular chamber formed by said second annular groove.

4. A gun as in claim 3, wherein said gas transfer passage is an annular space of predetermined size between the inner wall of said cylinder and the end portion of said piston between said annular groove and said end face of said piston.

* * * * *